US012240729B2

(12) United States Patent
Yamazaki

(10) Patent No.: US 12,240,729 B2
(45) Date of Patent: Mar. 4, 2025

(54) WIRE BODY WINDING DEVICE AND WIRE BODY WINDING METHOD

(71) Applicant: SUMITOMO ELECTRIC INDUSTRIES, LTD., Osaka (JP)

(72) Inventor: Takashi Yamazaki, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 666 days.

(21) Appl. No.: 17/610,511

(22) PCT Filed: May 8, 2020

(86) PCT No.: PCT/JP2020/018737
§ 371 (c)(1),
(2) Date: Nov. 11, 2021

(87) PCT Pub. No.: WO2020/230743
PCT Pub. Date: Nov. 19, 2020

(65) Prior Publication Data

US 2022/0219935 A1 Jul. 14, 2022

(30) Foreign Application Priority Data

May 13, 2019 (JP) ..... 2019-090694

(51) Int. Cl.
*B65H 65/00* (2006.01)
*B65H 54/22* (2006.01)
(Continued)

(52) U.S. Cl.
CPC ..... *B65H 65/00* (2013.01); *B65H 54/22* (2013.01); *B65H 54/71* (2013.01); *B65H 67/052* (2013.01); *B65H 2406/34* (2013.01)

(58) Field of Classification Search
CPC ..... B65H 65/00; B65H 54/22; B65H 54/71; B65H 67/052; B65H 2406/34; B65H 54/44
See application file for complete search history.

(56) References Cited

U.S. PATENT DOCUMENTS 3,347,477 A * 10/1967 Touze ..... B65H 67/052 242/474.4
3,837,589 A * 9/1974 Johnson ..... B65H 67/052 242/474.4
(Continued)

FOREIGN PATENT DOCUMENTS

CN 107973190 A 5/2018
JP H05-294553 A 11/1993
(Continued)

*Primary Examiner* — Sang K Kim
*Assistant Examiner* — Nathaniel L Adams
(74) *Attorney, Agent, or Firm* — Faegre Drinker Biddle & Reath LLP

(57) ABSTRACT

A wire body winding device that winds a wire body around a bobbin includes a bobbin pivoting mechanism that pivotally supports and pivots the bobbin, a wire body holding mechanism that holds the wire body, and a wire body moving mechanism configured to move the wire body holding mechanism. When the wire body is pulled out, the wire body moving mechanism moves the wire body holding mechanism between a take-up position where the wire body holding mechanism is capable of holding the wire body and a wire body winding position where the wire body is woundable around the bobbin.

6 Claims, 14 Drawing Sheets

(51) Int. Cl.
*B65H 54/71* (2006.01)
*B65H 67/052* (2006.01)

(56) References Cited

U.S. PATENT DOCUMENTS

| | | | | | |
|---|---|---|---|---|---|
| 4,223,848 | A * | 9/1980 | Brokke | B65H 67/052 | 242/474.4 |
| 4,239,187 | A * | 12/1980 | Boggs | B65H 65/00 | 242/476.1 |
| 4,557,423 | A * | 12/1985 | Zingler | B65H 65/00 | 242/476.6 |
| 2006/0138271 | A1 * | 6/2006 | Yamazaki | B65H 67/052 | 242/475.7 |

FOREIGN PATENT DOCUMENTS

| | | | |
|---|---|---|---|
| JP | H05-294554 | A | 11/1993 |
| JP | H08-151226 | A | 6/1996 |
| JP | H08-319062 | A | 12/1996 |
| JP | H10-077161 | A | 3/1998 |
| JP | 2005-219855 | A | 8/2005 |
| JP | 2018-070274 | A | 5/2018 |

* cited by examiner

WIRE BODY WINDING DEVICE AND WIRE BODY WINDING METHOD

TECHNICAL FIELD

The present disclosure relates to a wire body winding device and a wire body winding method.

The present application claims priority from Japanese Patent Application NO. 2019-090694 filed on May 13, 2019, contents of which are incorporated by reference in its entirety.

BACKGROUND ART

In the related art, a winding device that includes a wire body taking up portion, a wire body catching portion, and a wire body cleaving portion is known as a winding machine that winds an optical fiber around a bobbin. (for example, see Patent Literature 1).

CITATION LIST

Patent Literature

Patent Literature 1: JP-A-2005-219855

SUMMARY OF INVENTION

According to one aspect of the present disclosure, there is provided a wire body winding device that winds a wire body around a bobbin. The wire body winding device includes a bobbin pivoting mechanism that pivotally supports and pivots the bobbin, a wire body holding mechanism that holds the wire body, and a wire body moving mechanism configured to move the wire body holding mechanism, in which at the time of pulling out, the wire body moving mechanism moves the wire body holding mechanism between a take-up position where the wire body holding mechanism is configured to hold the wire body and a wire body winding position where the wire body is configured to be wound around the bobbin.

According to another aspect of the present disclosure, there is provided a wire body winding method using a wire body winding device. The wire body winding device includes a plurality of bobbin pivoting mechanisms that pivotally support and pivot a bobbin around which a wire body is to be wound, a wire body holding mechanism that holds the wire body, a wire body moving mechanism configured to move the wire body holding mechanism, a bobbin selection mechanism configured to set the bobbin around which the wire body is to be wound, and a wire body cleaving mechanism configured to cleave the wire body. The wire body winding method includes a holding step of the wire body holding mechanism holding the wire body at the time of being pulled out, a moving step of moving the wire body holding mechanism to a wire body winding position where the wire body is configured to be wound around the bobbin after the holding step, a setting step of the bobbin selection mechanism setting the bobbin around which the wire body is to be wound after the moving step, a locking step of a wire body catching portion of the bobbin locking the wire body after the setting step, and a cleaving step of the wire body cleaving mechanism cleaving the wire body locked to the bobbin after the locking step.

DESCRIPTION OF EMBODIMENTS

Figure 1A:
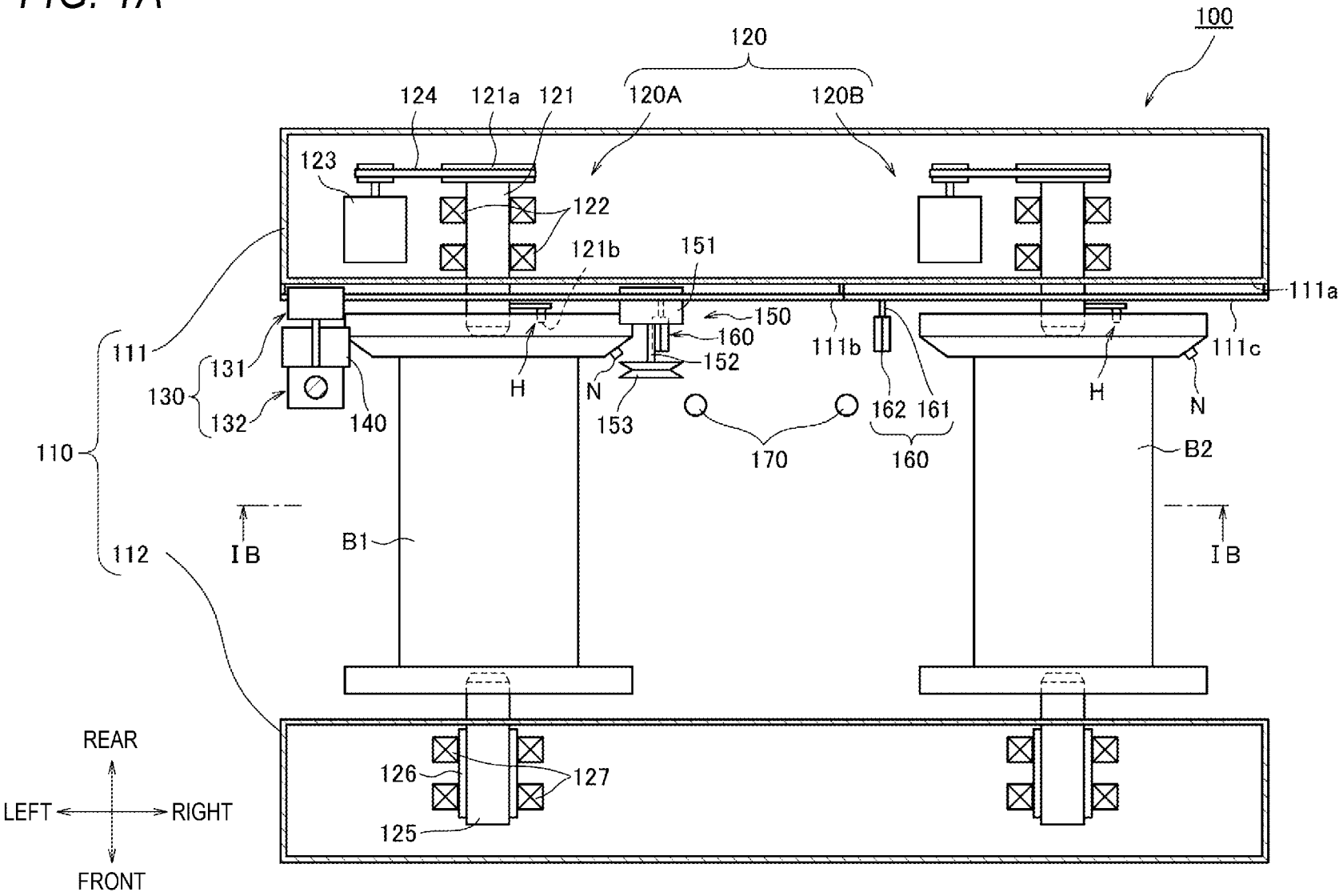
FIG. 1A is a plan cross-sectional view showing a wire body winding device according to a first embodiment of the present disclosure.

Problems to be Solved by Present Disclosure

When switching to a winding bobbin to start winding, winding can be started using the winding device disclosed in Patent Literature 1.

However, when winding is started at the beginning (when pulling out is started), an operator needs to hold the optical fiber up to the bobbin and wind the optical fiber around the bobbin.

Since a wire body is continuously supplied from the optical fiber base material side even during the operation, the operator needs to quickly wind an optical fiber around the bobbin.

When the bobbin is increased in size and the bobbin is supported from both sides, there is no work space for the operator, and thus it is difficult for the operator to perform a bobbin winding operation.

The present disclosure has been made in view of such circumstances, and an object of the present disclosure is to provide a wire body winding device and a wire body winding method that automatically and easily wind the wire body around a bobbin.

Effects of Present Disclosure

According to the present disclosure, it is possible to automatically and easily wind a wire body around a bobbin.

Embodiments of Present Disclosure

First, contents of embodiments of the present disclosure will be listed and described.

According to an aspect of the present disclosure, (1) there is provided a wire body winding device that winds a wire body around a bobbin. The wire body winding device includes a bobbin pivoting mechanism that pivotally supports and pivots the bobbin, a wire body holding mechanism that holds the wire body, and a wire body moving mechanism configured to move the wire body holding mechanism, in which at the time of pulling out, the wire body moving mechanism moves the wire body holding mechanism between a take-up position where the wire body holding mechanism is configured to hold the wire body and a wire body winding position where the wire body is configured to be wound around the bobbin.

Accordingly, an operator can wind the wire body around the bobbin only by holding the wire body in the wire body holding mechanism, and the operator does not directly wind the wire body around the bobbin, so that a winding operation around the bobbin can be automated and simplified.

(2) In the wire body winding device described above, a plurality of the bobbin pivoting mechanisms are provided, and each of the bobbin pivoting mechanisms includes a rotation shaft that is inserted into one end side of the bobbin to drive the bobbin, a motor that rotates the rotation shaft, and a support shaft that is inserted into the other end side of the bobbin to support the bobbin.

Accordingly, all bobbins are supported from both sides, and support strength of the bobbins is increased. Therefore, even when all of the bobbins have a large size, the bobbins can be supported.

In a case where the bobbins are supported from both sides (double-sided), when the operator directly winds the wire body around a bobbin, it may be difficult for the operator to put his hand to the bobbin. In the wire body winding device described above, when the wire body holding mechanism holds the wire body, the wire body holding mechanism is automatically moved up to a wire body winding position, so that the winding operation can be performed automatically and easily even when the bobbin has a double-sided structure.

(3) In the wire body winding device described above, the bobbin has a wire body catching portion that locks the wire body, and the wire body winding device further includes a bobbin selection mechanism configured to set the bobbin around which the wire body is to be wound, and a wire body cleaving mechanism configured to cleave the wire body locked to the bobbin.

Accordingly, since the wire body is wound around another bobbin without reducing a wire body speed, the wire body is continuously wound without loss.

(4) In the wire body winding device described above, the wire body holding mechanism is at least one of a suction nozzle configured to suction the wire body or a pinch roller configured to pinch the wire body.

Accordingly, the optical fiber is reliably held at the time of being pulled out.

(5) In the wire body winding device described above, a moving speed of the wire body holding mechanism is slower than a wire body pulling out speed of the wire body.

Accordingly, a shortage of the optical fiber supplied from an optical fiber base material side is avoidable. Therefore, the optical fiber is not strongly pulled by the wire body holding mechanism during a movement of the wire body holding mechanism and the optical fiber is not broken, and the optical fiber can be efficiently wound around the bobbin.

(6) According to another aspect of the present disclosure, there is provided a wire body winding method using a wire body winding device. The wire body winding device includes a plurality of bobbin pivoting mechanisms that pivotally support and pivot a bobbin around which a wire body is to be wound, a wire body holding mechanism that holds the wire body, a wire body moving mechanism configured to move the wire body holding mechanism, a bobbin selection mechanism configured to set the bobbin around which the wire body is to be wound, and a wire body cleaving mechanism configured to cleave the wire body. The wire body winding method includes a holding step of the wire body holding mechanism holding the wire body at the time of being pulled out, a moving step of moving the wire body holding mechanism to a wire body winding position where the wire body is configured to be wound around the bobbin after the holding step, a setting step of the bobbin selection mechanism setting the bobbin around which the wire body is to be wound after the moving step, a locking step of a wire body catching portion of the bobbin locking the wire body after the setting step, and a cleaving step of the wire body cleaving mechanism cleaving the wire body locked to the bobbin after the locking step.

Accordingly, an operator can wind the wire body around the bobbin only by holding the wire body in the wire body holding mechanism, and the operator does not directly wind the wire body around the bobbin, so that a winding operation around the bobbin can be automated and simplified.

Details of First Embodiment of Present Disclosure

Hereinafter, a specific structure of a wire body winding device 100 and a wire body winding method using the winding device 100 according to a first embodiment of the present disclosure will be described with reference to FIGS. 1A to 2I.

Figure 1B:
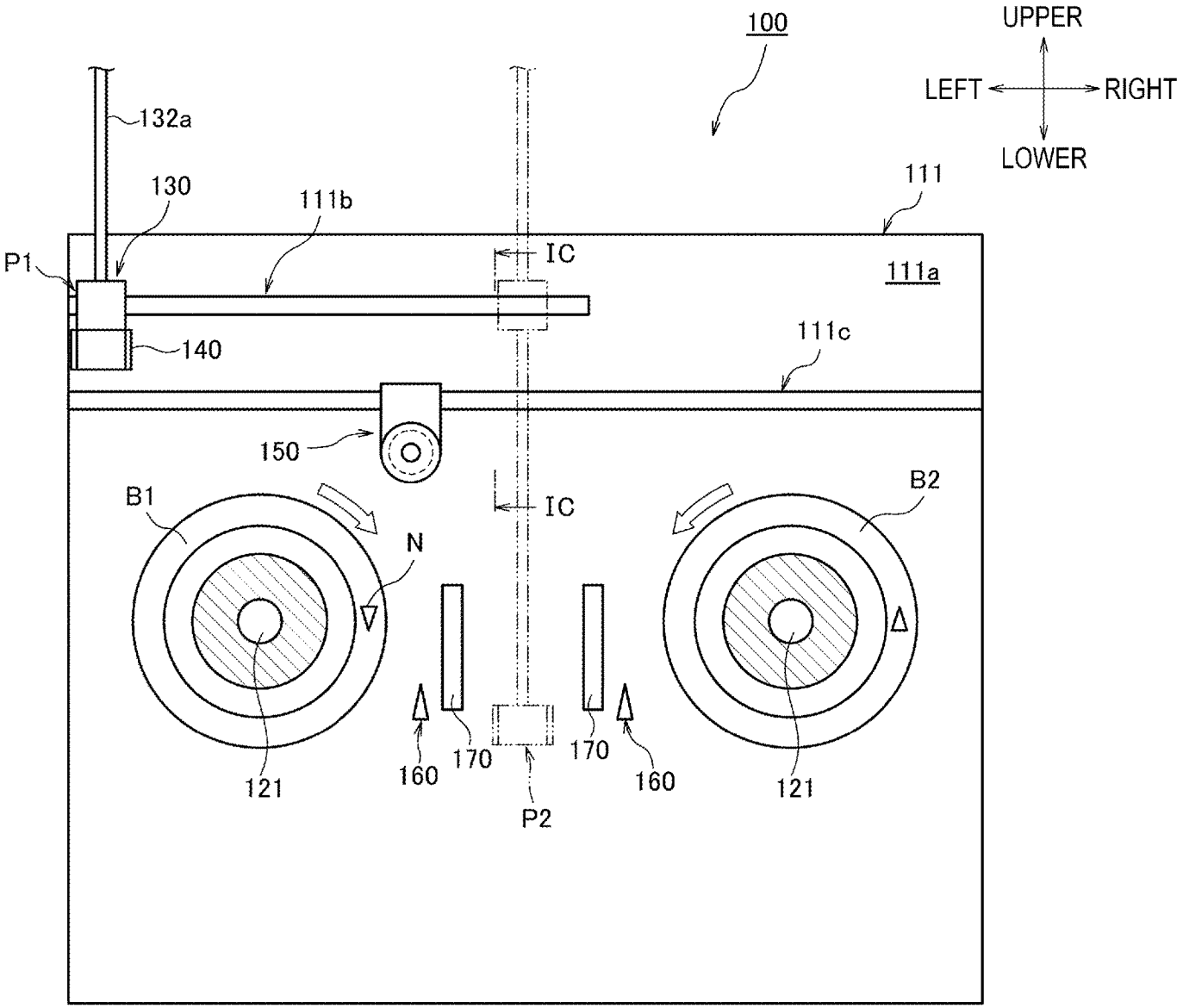
FIG. 1B is a cross-sectional view taken along a line IB-IB in FIG. 1A.
Figure 1C:
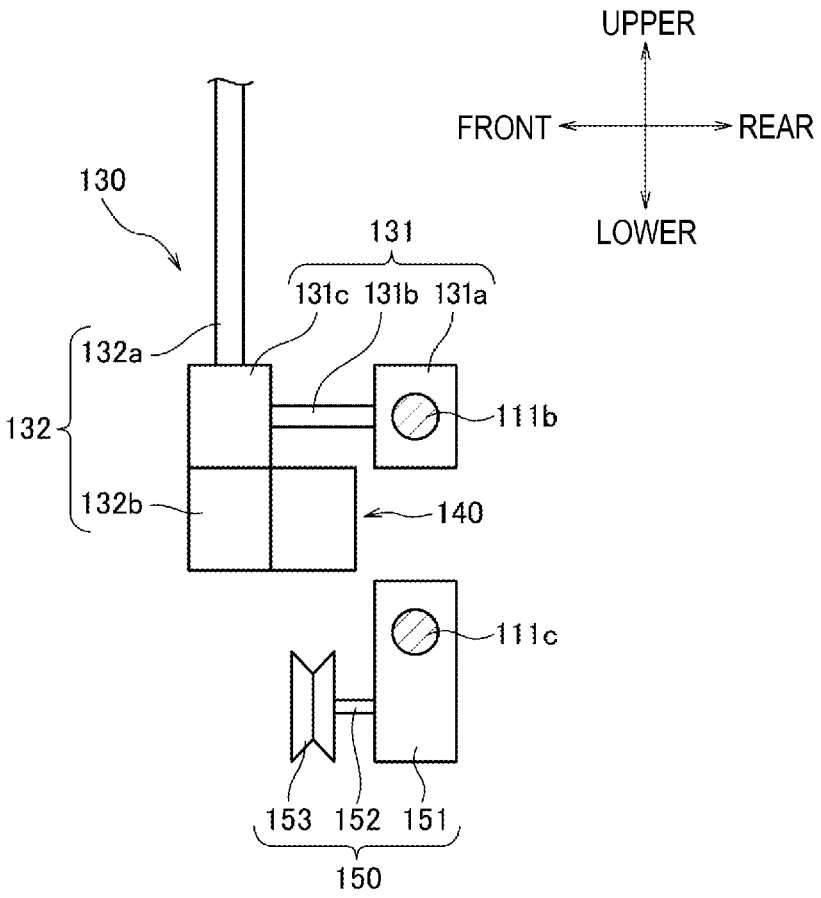
FIG. 1C is a main part cross-sectional view taken along a line IC-IC in FIG. 1B.

FIG. 1A is a plan cross-sectional view showing the wire body winding device according to the first embodiment of the present disclosure. FIG. 1B is a cross-sectional view taken along a line IB-IB in FIG. 1A. FIG. 1C is a cross-sectional view taken along a line IC-IC showing main parts in FIG. 1B. FIG. 2A to FIG. 2D are front cross-sectional views showing the winding device for explaining the wire body winding method. FIG. 2E is a cross-sectional view taken along a line IIE-IIE in FIG. 2D. FIG. 2F is a plan cross-sectional view showing the winding device for explaining the wire body winding method. FIG. 2G to FIG. 2I are front sectional views showing the winding device for explaining the wire body winding method.

In the following description, configurations denoted by the same reference numerals in different drawings are the same, and description thereof may be omitted.

Further, the present disclosure is not limited to these examples, is indicated by the claims, and is intended to include modifications within a scope and meaning equivalent to the claims.

[Wire Body Winding Device]

First, a specific structure of the winding device 100 will be described with reference to FIGS. 1A to 1C.

The winding device 100 according to an embodiment of the present disclosure is a device used to wind an optical fiber that is a wire body around two bobbins B1 and B2 as shown in FIGS. 1A to 1C.

In the bobbin used in the present embodiment, flanges are provided at two ends of a cylindrical body portion, and an engagement hole H to be engaged with a kere pin 121*b* which will be described later is formed in one flange.

As shown in FIGS. 1A to 1C, the winding device 100 includes a frame 110 that faces both flange surfaces of the bobbins B1 and B2, a bobbin pivoting mechanism 120 that pivotally supports and pivots the bobbins B1 and B2, a wire body moving mechanism 130 that is attached to the frame 110 and moves the optical fiber into the winding device 100, and a wire body holding mechanism 140 that holds the optical fiber.

The winding device 100 further includes a bobbin selection mechanism 150 that sets a bobbin around which the optical fiber is to be wound, a cutter (wire body cleaving mechanism) 160 that cuts off the optical fiber, and wire body aligning guides 170 that are movable in a front-rear direction and push the optical fiber.

[Frame]

The frame 110 includes a first frame 111 that accommodates a motor 123 and the like to be described later, and a second frame 112 that faces the first frame 111 at a given distance from the first frame 111.

The bobbins B1 and B2 are disposed between the first frame 111 and the second frame 112.

A first guide rail 111*b* and a second guide rail 111*c* that extend in a left-right direction are provided on a front surface 111*a* of the first frame 111.

A cross-sectional shape of the first guide rail 111*b* and the second guide rail 111*c* is, for example, a circular shape as shown in FIG. 1C.

The first guide rail 111*b* is provided above the second guide rail 111*c*.

Further, a length of the first guide rail 111*b* in the left-right direction is shorter than a length of the second guide rail 111*c* in the left-right direction.

[Bobbin Pivoting Mechanism]

The bobbin pivoting mechanism 120 includes a first bobbin pivoting mechanism 120A that pivots the bobbin B1 and a second bobbin pivoting mechanism 120B that pivots the bobbin B2.

A pivoting direction of the bobbin B1 by the first bobbin pivoting mechanism 120A is clockwise in a front view, and a pivoting direction of the bobbin B2 by the second bobbin pivoting mechanism 120B is counterclockwise in a front view.

The first bobbin pivoting mechanism 120A and the second bobbin pivoting mechanism 120B have the same structure, and thus only the first bobbin pivoting mechanism 120A will be described below.

The first bobbin pivoting mechanism 120A includes, in the first frame 111, a rotation shaft 121 of which one end is inserted into one end side of the bobbin B1 to drive the bobbin B1, a bearing 122 that supports a load of the bobbin B1 on the rotation shaft 121, the motor 123 that rotates the rotation shaft 121, and a transmission belt 124 that couples the rotation shaft 121 and the motor 123 to transmit the rotation of the motor 123 to the rotation shaft 121.

Further, the first bobbin pivoting mechanism 120A includes, in the second frame 112, a support shaft 125 that is inserted into the other end side of the bobbin B1 and supports the bobbin B1, a sleeve 126 that covers the support shaft 125, and a bearing 127 that supports a load of the bobbin B1 on the sleeve 126 (the support shaft 125).

The rotation shaft 121 is inserted into the bobbin B1 at a front end side, and a pulley 121*a* is press-fitted to a rear end side of the rotation shaft 121.

The transmission belt 124 is hung on the pulley 121*a*.

A kere pin 121*b* that extends in the same direction as the rotation shaft 121 is provided at a side of the front end side of the rotation shaft 121.

When the rotation shaft 121 is inserted into the bobbin B1, the kere pin 121*b* is inserted into the engagement hole H of the bobbin B1.

Accordingly, the bobbin B1 does not idle relative to the rotation shaft 121, and can be pivoted integrally with the rotation shaft 121.

The support shaft 125 is slidable in the front-rear direction relative to the sleeve 126.

Accordingly, the bobbins B1 and B2 can be attached to the winding device 100 or the bobbins B1 and B2 can be detached from the winding device 100 only by sliding the support shaft 125.

[Wire Body Moving Mechanism]

The wire body moving mechanism 130 is a mechanism for moving the wire body holding mechanism 140 in upper, lower, left, and right directions. As shown in FIG. 1C, the wire body moving mechanism 130 includes a horizontal slide portion 131 that is movable in the left-right direction on the first guide rail 111*b* of the first frame 111, and a vertical slide portion 132 that is movable in a vertical direction.

The horizontal slide portion 131 includes a slide member 131*a* through which the first guide rail 111*b* is inserted and that is movable on the first guide rail 111*b*, an arm 131*b* of which a rear end is connected to a front side of the slide member 131*a* and that extends forward, and a coupling member 131*c* to which a front end of the arm 131*b* is connected and that is coupled to the vertical slide portion 132.

The vertical slide portion 132 includes a guide shaft 132*a* that extends in the vertical direction and is inserted through the coupling member 131*c*, and a guide shaft holding member 132*b* that has a rectangular parallelepiped shape and is provided at a lower end of the guide shaft 132*a*.

The wire body holding mechanism 140 is held on a rear surface of the guide shaft holding member 132*b*.

Since the horizontal slide portion 131 and the vertical slide portion 132 are provided, the wire body moving mechanism 130 and the wire body holding mechanism 140 are movable between a take-up position P1 where the optical fiber can be held at the time of starting to be pulled out and a wire body winding position P2 where the optical fiber can be wound around the bobbins B1 and B2, as shown in FIG. 1B.

Here, the take-up position P1 refers to a position at a left end side of the first frame 111, and the wire body winding position P2 refers to a position at substantially the center of the first frame 111 (that is, substantially the middle of two wire body aligning guides 170 in a front view). The wire body winding position P2 is located below a cutter 160 when the wire body holding mechanism 140 is moved.

[Wire Body Holding Mechanism]

The wire body holding mechanism 140 is a mechanism that holds the optical fiber drawn from the optical fiber base material when the optical fiber is pulled out, and may be a pinch roller that holds the optical fiber by sandwiching the optical fiber with two rollers, may be a suction nozzle that holds the optical fiber by a negative pressure, or may be a combination of the pinch roller and the suction nozzle.

[Bobbin Selection Mechanism]

The bobbin selection mechanism 150 includes a slider 151 that is movable in the left-right direction on the second guide rail 111*c*, a shaft 152 that extends forward from the slider 151, and a guide roller 153 that has a V groove and is connected to a front end of the shaft 152.

When the bobbin selection mechanism 150 is moved in the left-right direction, a bobbin on which the optical fiber is to be wound can be selected.

[Cutter]

The cutter 160 is attached to the first frame 111, and includes an arm 161 coupled to the first frame 111, and a cutter blade 162 attached to a tip end of the arm 161.

[Wire Body Winding Method]

Next, a method of winding the optical fiber by the winding device 100 described above will be described with reference to FIGS. 2A to 2H.

Figure 2A:
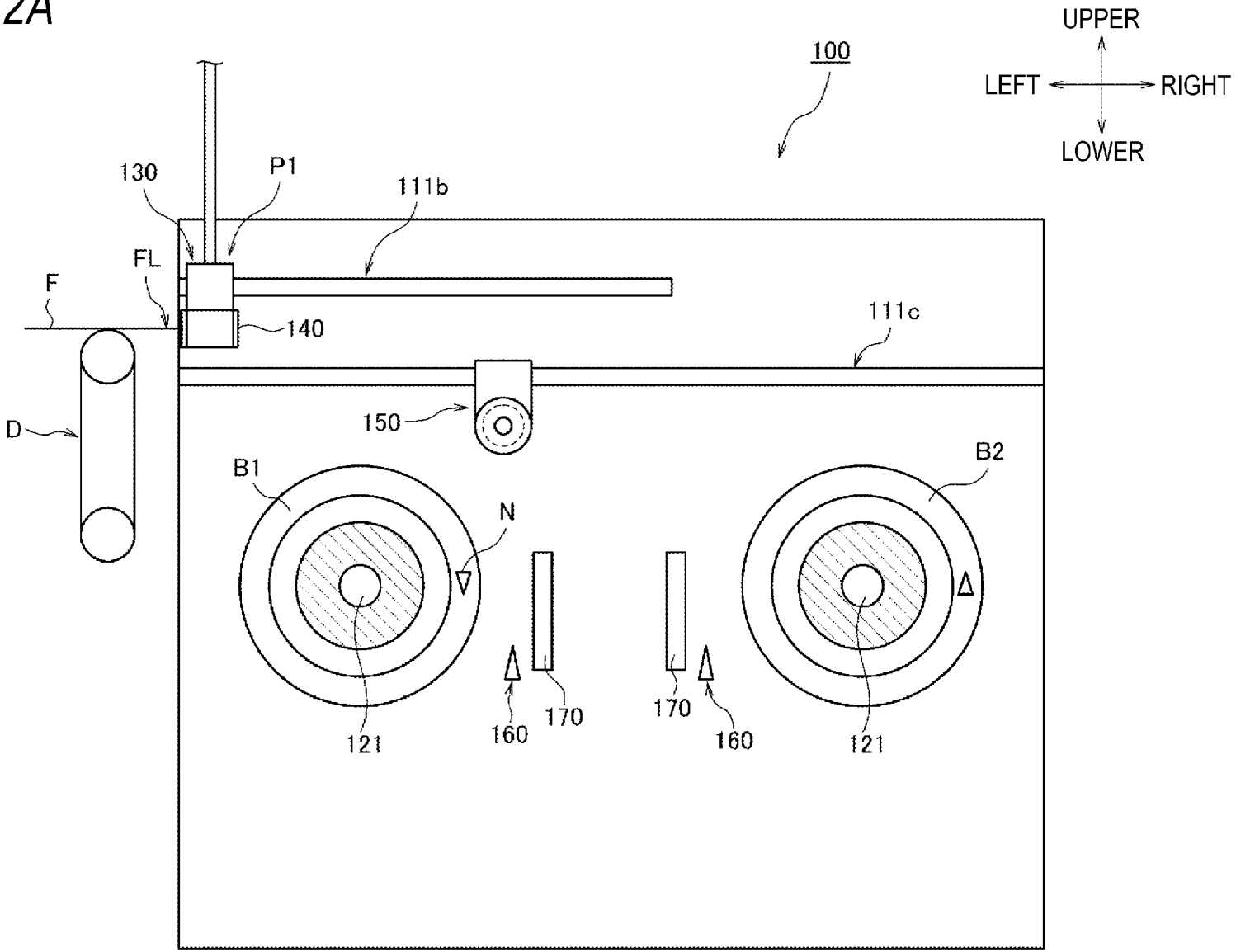
FIG. 2A is a front cross-sectional view showing a winding device for explaining a wire body winding method, and showing a state when pulling out is started.

As shown in FIG. 2A, a pull-out portion FL at a tip end of the optical fiber F that was pulled out from the optical fiber base material (not shown) is conveyed by a hand or the like, and is held by the wire body holding mechanism 140 at the take-up position P1 in a state in which tension is adjusted by a dancer roller D.

Figure 2B:
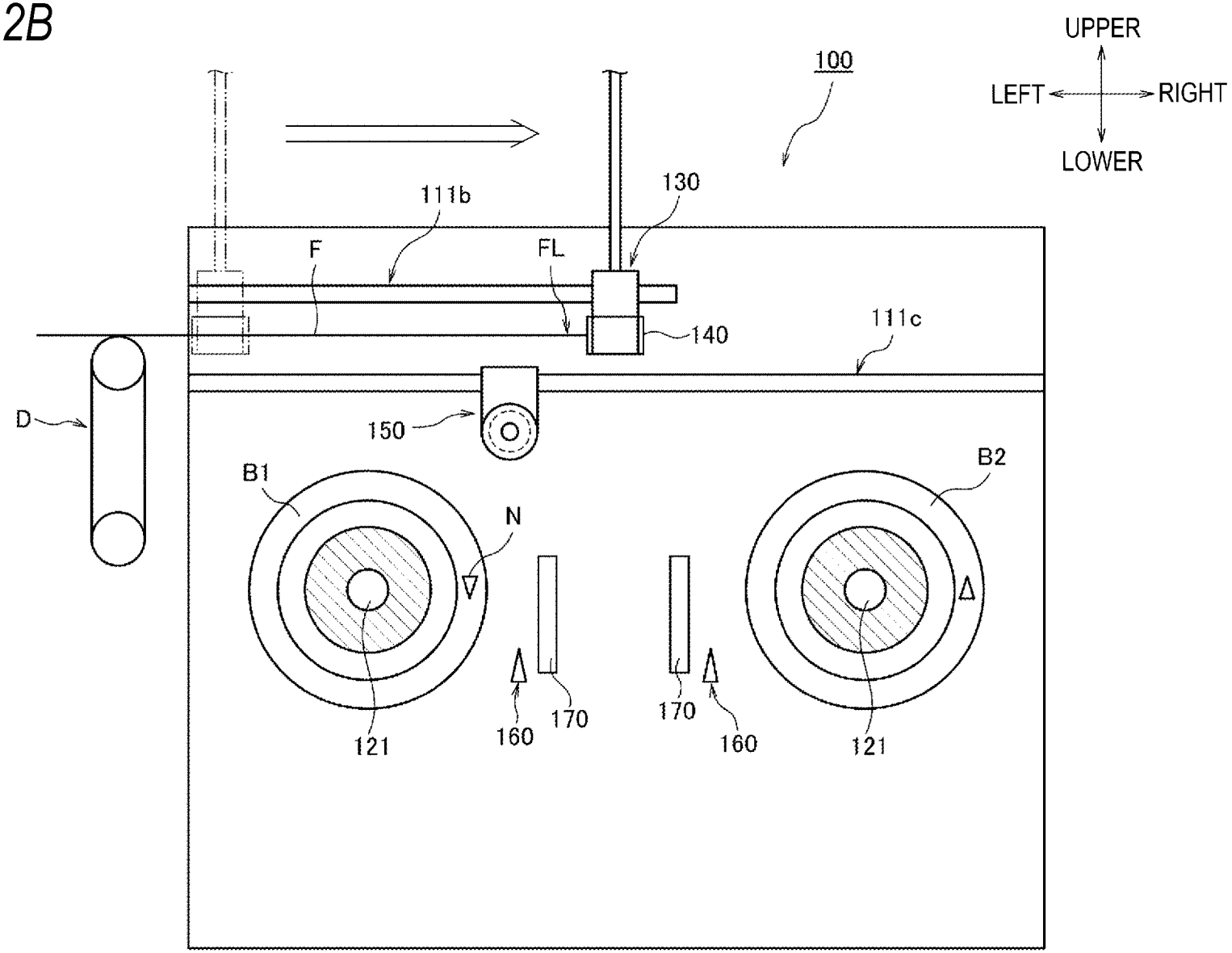
FIG. 2B is a front cross-sectional view showing the winding device for explaining the wire body winding method, and showing a state in which a wire body moving mechanism moves to a middle position of two wire body aligning guides.

When the pull-out portion FL of the optical fiber F is held by the wire body holding mechanism 140, as shown in FIG. 2B, the wire body moving mechanism 130 moves along the first guide rail 111*b* until the wire body moving mechanism 130 is positioned in the middle of the two wire body aligning guides 170 in a front view.

Figure 2C:
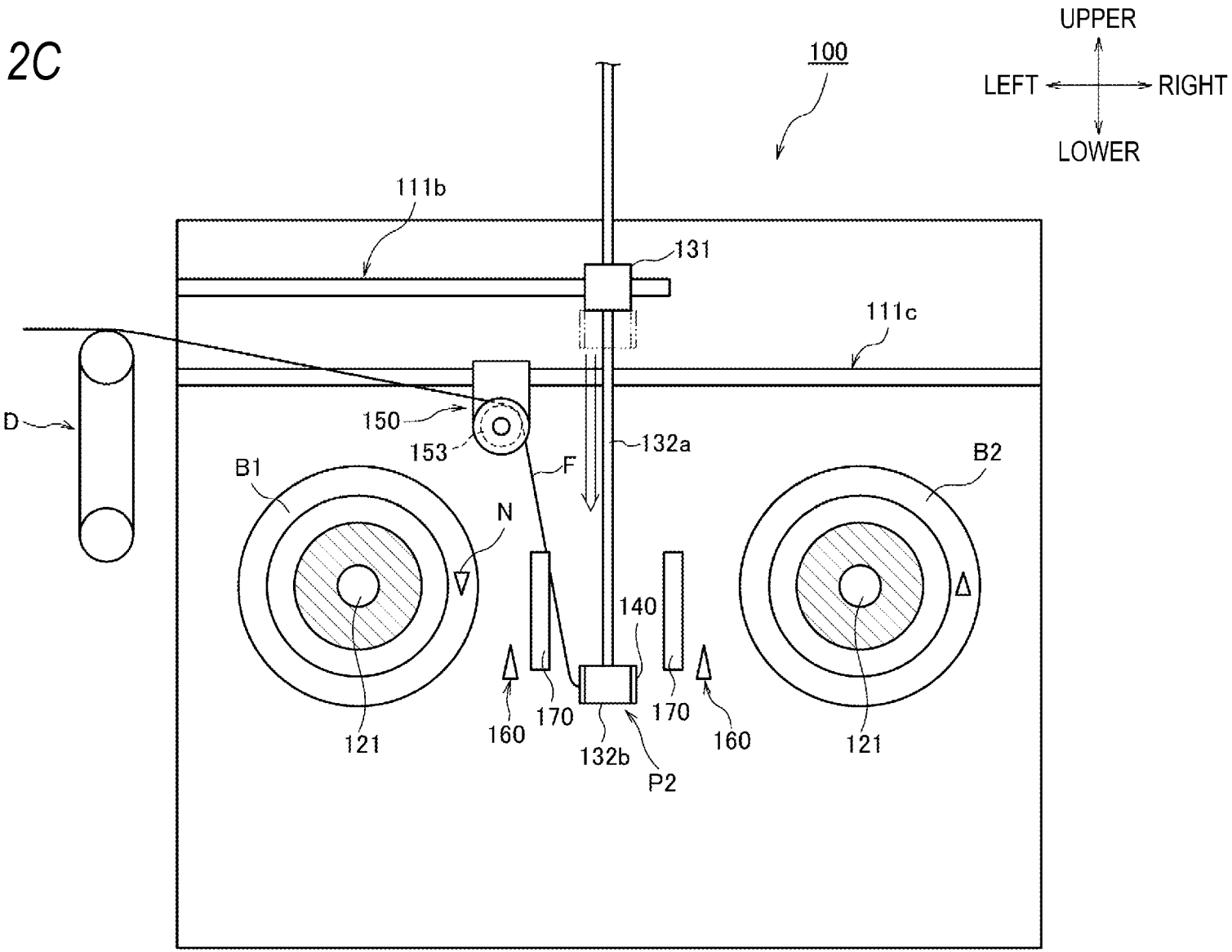
FIG. 2C is a front cross-sectional view showing the winding device for explaining the wire body winding method, and showing a state in which the wire body moving mechanism is moved downward.

Thereafter, as shown in FIG. 2C, the guide shaft 132*a* is lowered downward, so that the guide shaft holding member 132*b* is lowered vertically downward to the wire body winding position P2.

That is, the wire body holding mechanism 140 holds the pull-out portion FL of the optical fiber F and is moved from the take-up position P1 to the wire body winding position P2.

Accordingly, the optical fiber F is wound around the guide roller 153 of the bobbin selection mechanism 150.

A moving speed of the horizontal slide portion 131 and the vertical slide portion 132 at this time is slower than a pulling out speed from the optical fiber base material (that is, a wire body pulling out speed of the optical fiber).

However, since the optical fiber F remained in the wire body holding mechanism 140 are suctioned, the optical fiber F does not remain on the dancer roller D or the optical fiber F on a pass line is not loosened.

Next, the bobbin selection mechanism 150 is moved to a bobbin side around which the optical fiber F is to be wound.

Figure 2D:
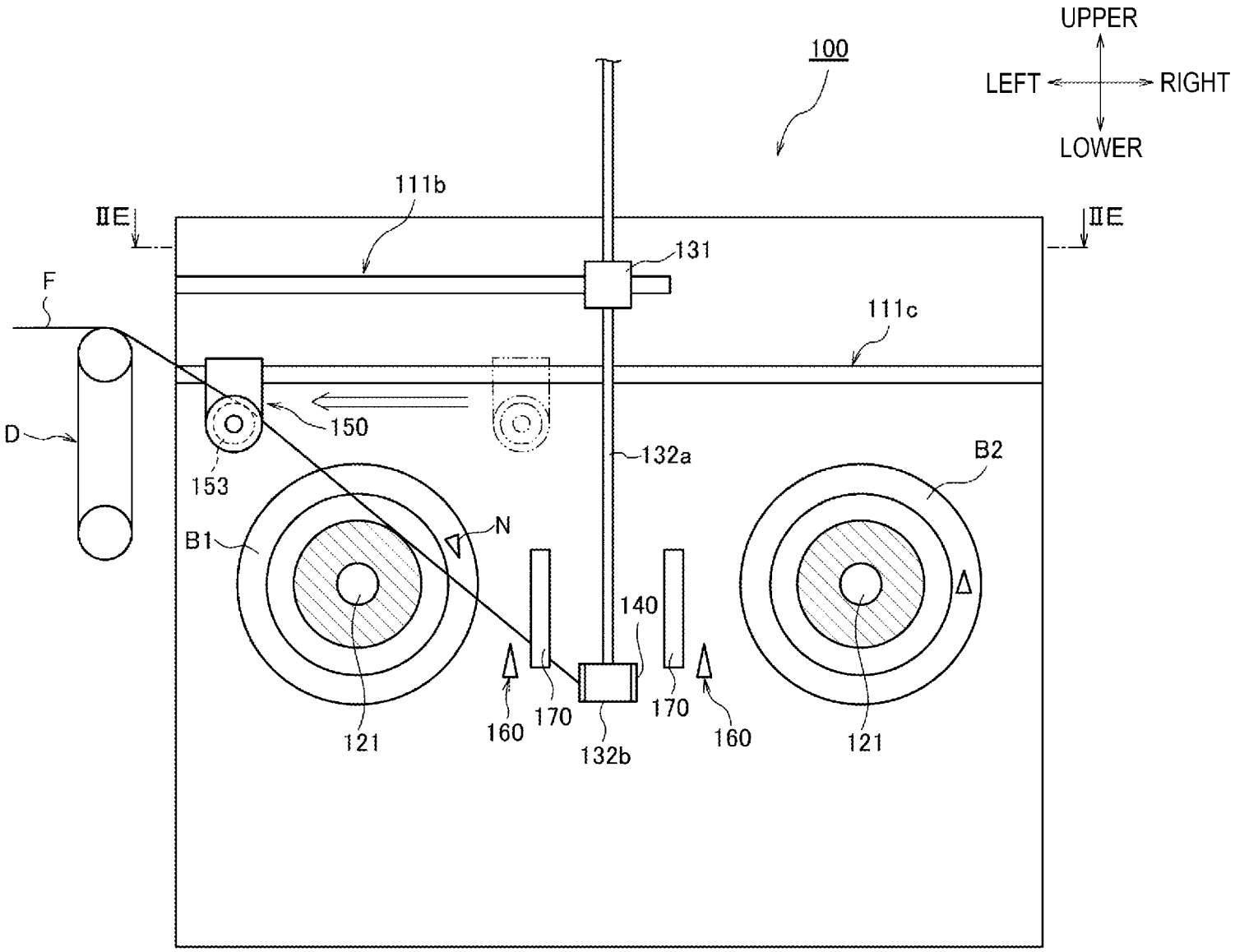
FIG. 2D is a front cross-sectional view showing the winding device for explaining the wire body winding method, and showing a state in which a bobbin selection mechanism is moved to the left.
Figure 2E:
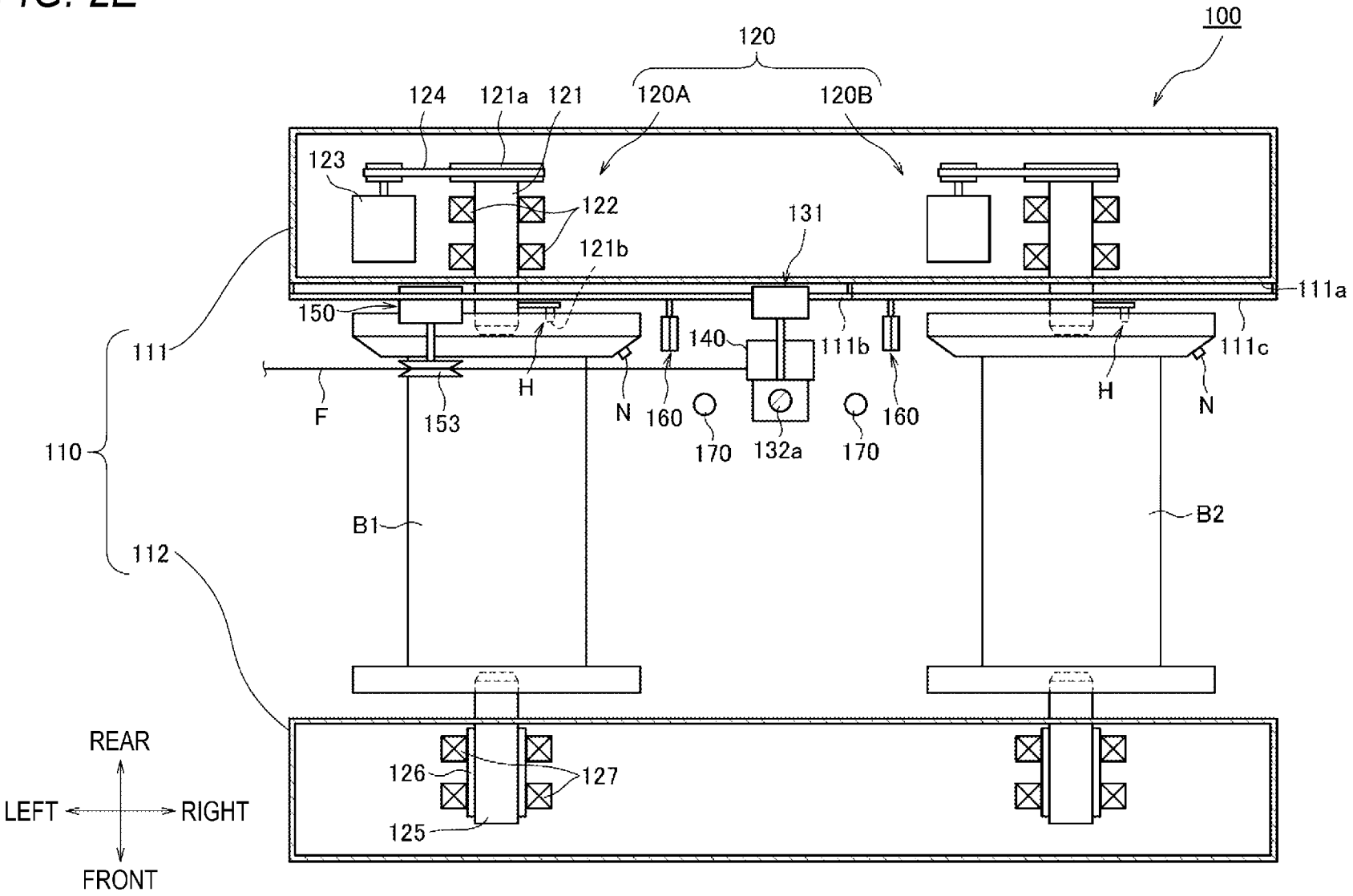
FIG. 2E is a cross-sectional view taken along a line IIE-IIE in FIG. 2D.
Figure 2F:
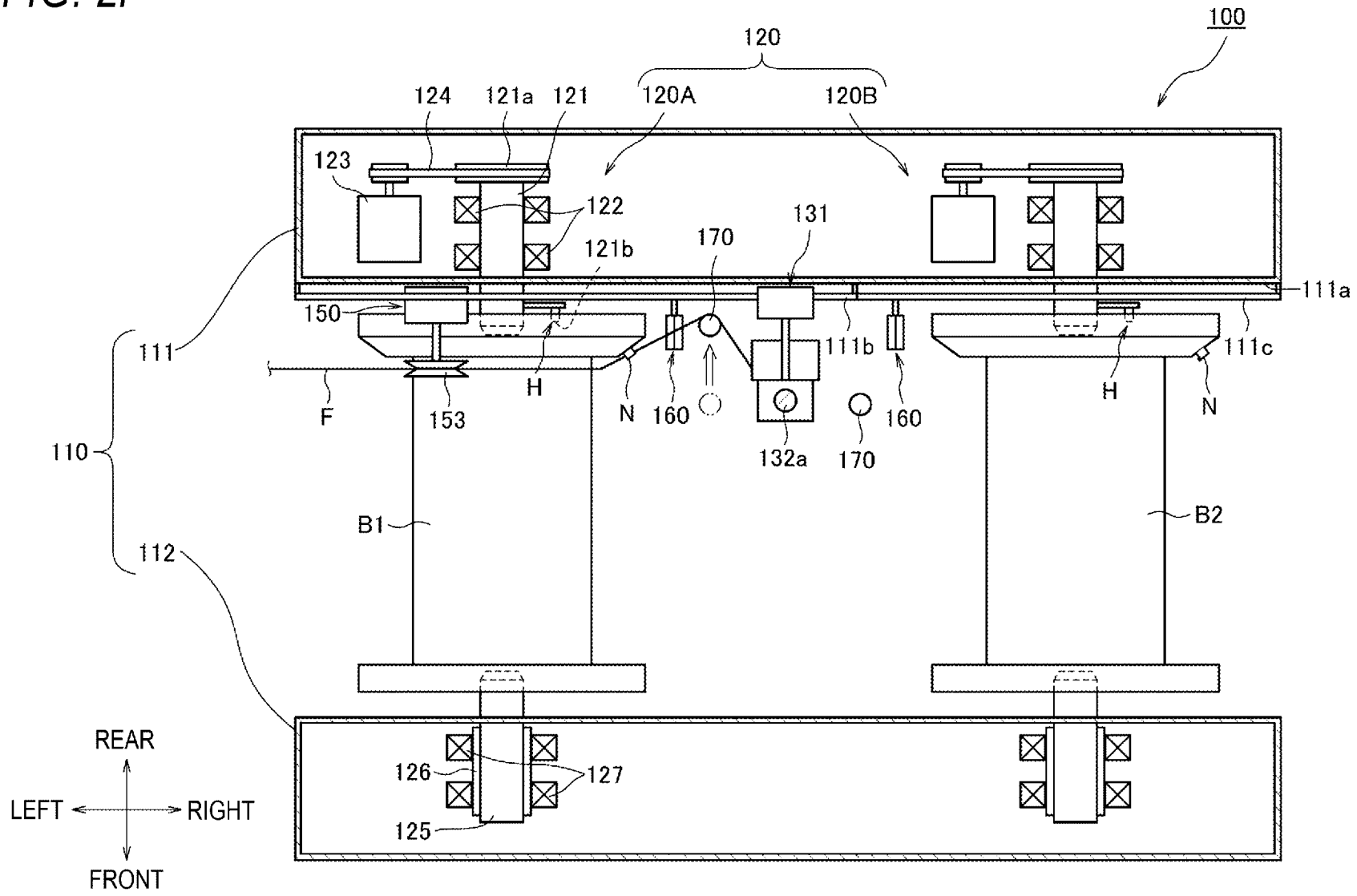
FIG. 2F is a plan cross-sectional view showing the winding device for explaining the wire body winding method, and showing a state in which the bobbin selection mechanism is moved toward a flange.
Figure 2G:
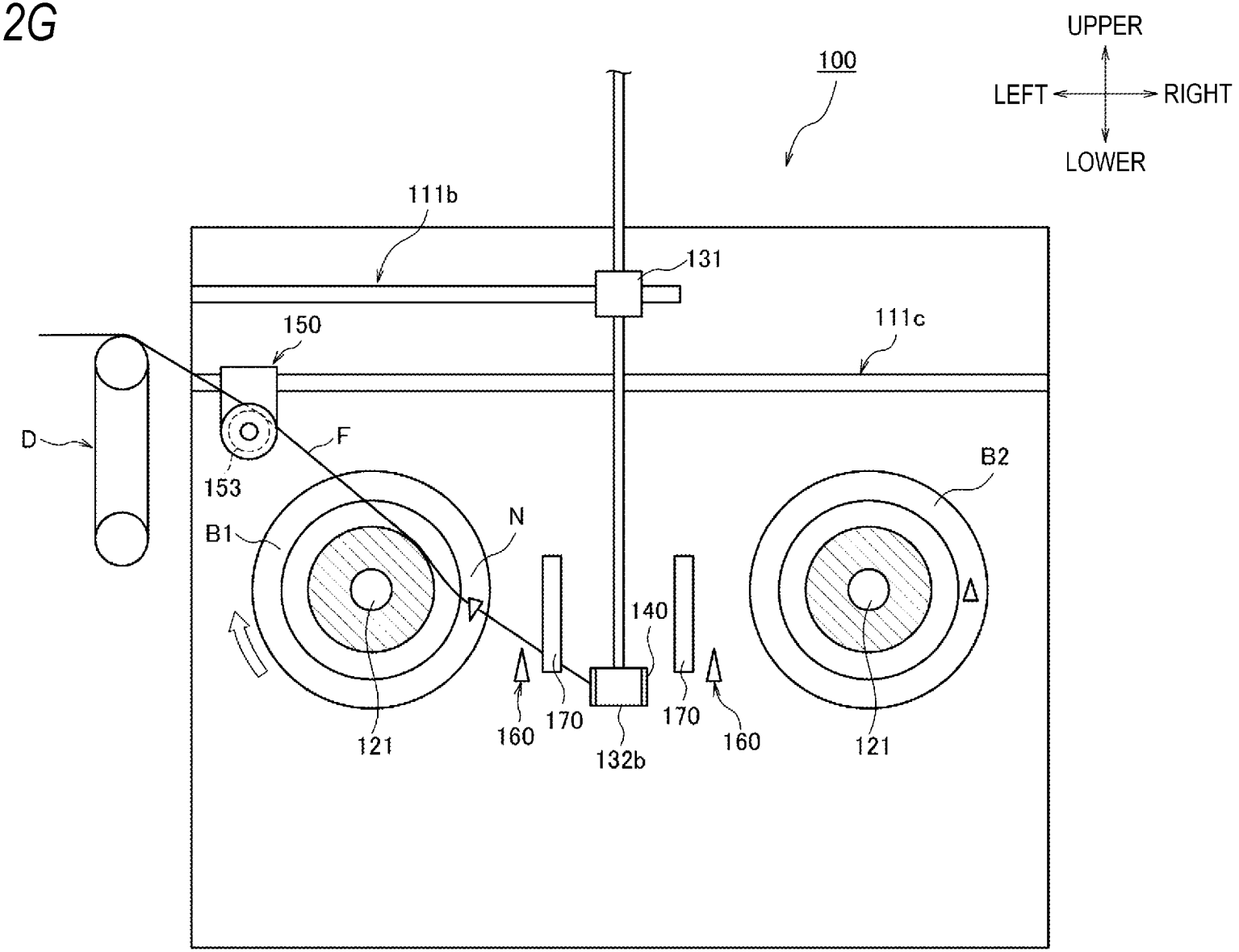
FIG. 2G is a front cross-sectional view showing the winding device for explaining the wire body winding method, and showing a state in which an optical fiber is locked to a bobbin.
Figure 2H:
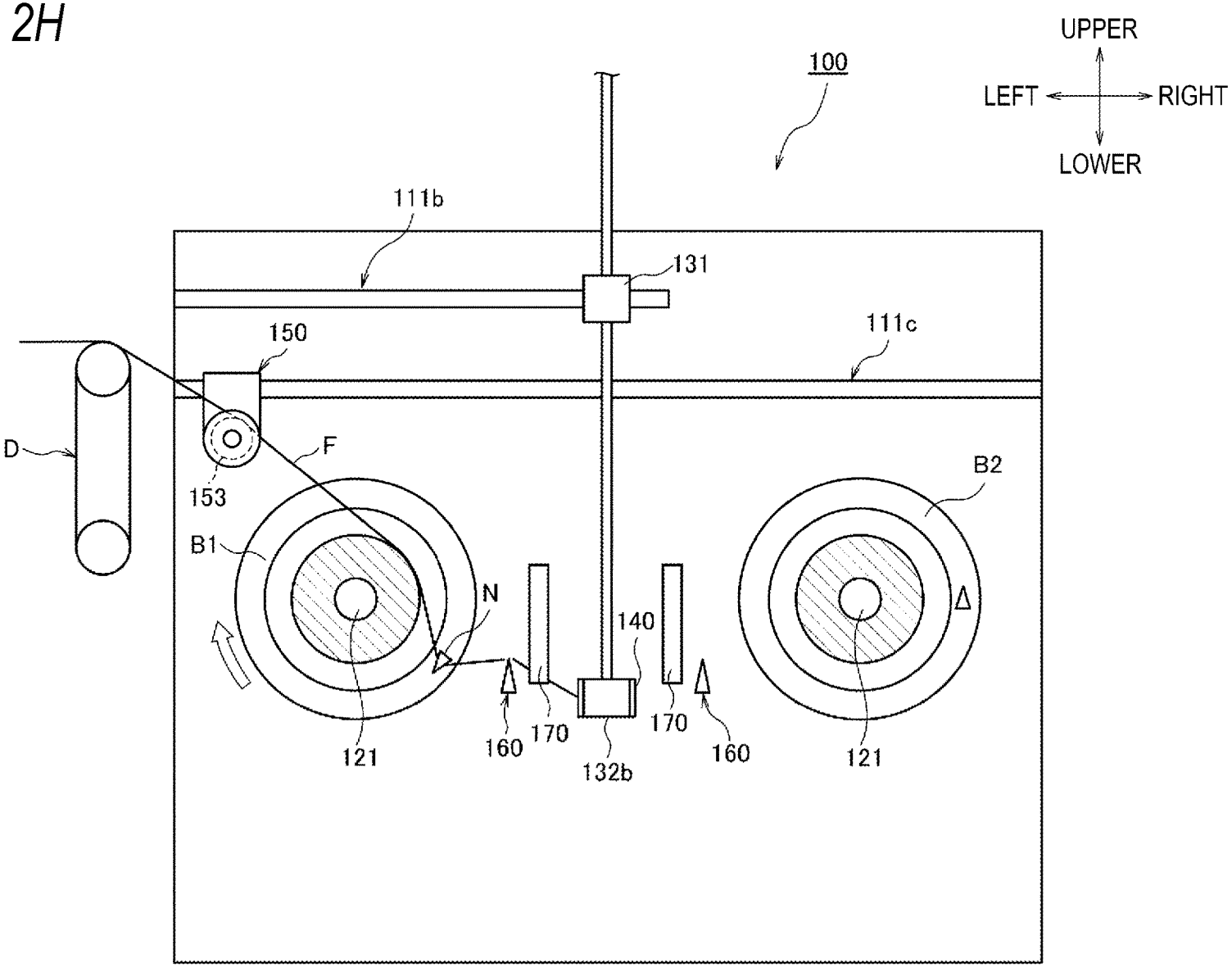
FIG. 2H is a front cross-sectional view showing the winding device for explaining the wire body winding method, and showing a state in which the optical fiber is cleft.
Figure 2I:
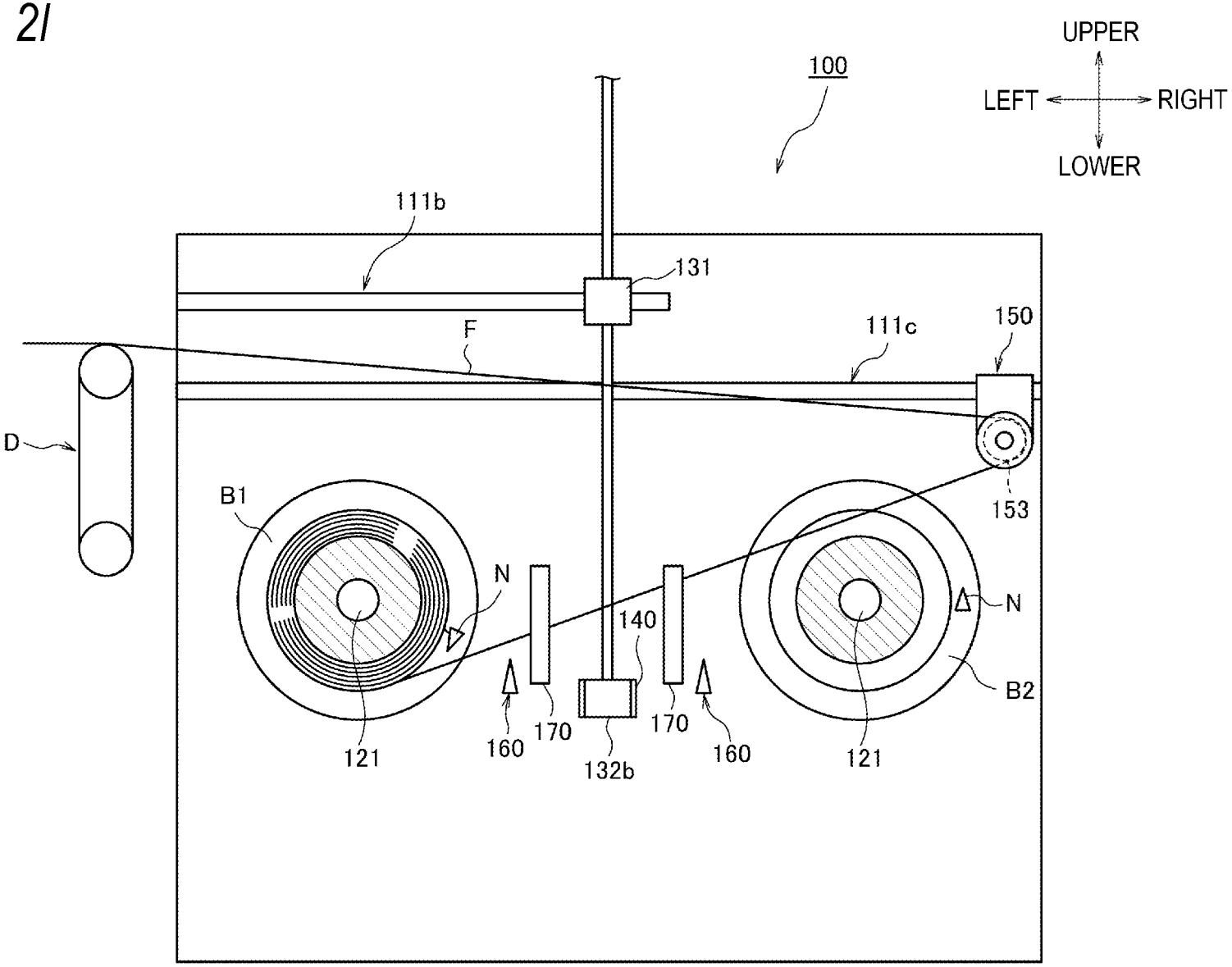
FIG. 2I is a front cross-sectional view showing the winding device for explaining the wire body winding method, and showing a state in which winding bobbins are to be switched.

In order to wind the optical fiber F around the bobbin B1, as shown in FIG. 2D, the bobbin selection mechanism 150 is moved to the left side along the second guide rail 111*c* in the present embodiment.

A cross-sectional plan view of the winding device 100 at this time is FIG. 2E.

Next, as shown in FIG. 2F, the wire body aligning guides 170 are moved rearward (toward the first frame 111) to align the optical fiber F to a flange side of the bobbin B1.

At this time, the optical fiber F comes into contact with a flange of the bobbin B1.

In this state, the bobbin B1 is rotated.

Accordingly, as shown in FIG. 2G, the optical fiber F is caught by a claw N that is a wire body catching portion for locking the optical fiber F to the bobbin B1, and the optical fiber F is locked to the bobbin B1.

When the bobbin B1 is further rotated, the optical fiber F is pressed against the cutter 160, and the optical fiber F is cleft as shown in FIG. 2H.

Thereafter, winding of the optical fiber F around the bobbin B1 is started.

A procedure of winding the pull-out portion FL of the optical fiber F around the bobbin B1 for the first time has been described above.

When the pull-out portion FL of the optical fiber F is to be wound around the bobbin B2 for the first time, the pull-out portion FL of the optical fiber F may be held by the wire body holding mechanism 140, and the bobbin selection mechanism 150 may be moved up to the wire body winding position P2 and then aligned to the bobbin B2 side.

[Switching of Winding Bobbins]

Next, switching of bobbins for winding the optical fiber will be described with reference to FIG. 2H and FIG. 2I.

When the winding of the optical fiber F around the bobbin B1 is started from the state shown in FIG. 2H and the winding of the optical fiber F around the bobbin B1 is completed, the bobbin selection mechanism 150 is moved to a right side along the second guide rail 111*c* as shown in FIG. 2I in order to wind the optical fiber F around the bobbin B2. Next, the wire body aligning guides 170 are moved rearward (toward the first frame 111) to align the optical fiber F to a flange side of the bobbin B2.

Then, the bobbin B2 is rotated, so that the optical fiber F is caught by a claw N, and the optical fiber F is locked to the bobbin B2.

When the bobbin B2 is further rotated, the optical fiber F is pressed against the cutter 160, and the optical fiber F is cleft.

Thereafter, winding of the optical fiber F around the bobbin B2 is started.

In the winding device 100 according to the first embodiment of the present disclosure configured as described above, when pulling out is started, the wire body holding mechanism 140 is movable between the take-up position P1 where the optical fiber F that is a wire body can be held and the wire body winding position P2 where the optical fiber F can be wound around the bobbins B1 and B2.

When the wire body holding mechanism 140 holds the optical fiber F and moves from the take-up position P1 to the wire body winding position P2, an operator can wind the optical fiber F around the bobbins B1 and B2 only by holding the optical fiber F in the wire body holding mechanism 140, and a winding operation around the bobbins B1 and B2 can be automated and simplified.

A plurality of bobbin pivoting mechanisms 120 are provided, and each of the bobbin pivoting mechanisms 120 includes the rotation shaft 121 that is inserted into one end side of each of the bobbins B1 and B2 and drives each of the bobbins B1 and B2, the motor 123 that rotates the rotation shaft 121, and a support shaft 125 that is inserted into the other end side of each of the bobbins B1 and B2 and supports each of the bobbins B1 and B2, so that the bobbins B1 and B2 can be supported from both sides, and support strength of the bobbins B1 and B2 is increased. Therefore, even when the bobbins B1 and B2 have a large size, both of the bobbins B1 and B2 can be supported.

Further, the wire body holding mechanism 140 holds the optical fiber F, and then the wire body holding mechanism 140 is automatically moved up to the wire body winding position P2, so that the winding operation can be performed automatically and easily even when the bobbins B1 and B2 have a double-sided structure.

The bobbins B1 and B2 each have the claw N that is a wire body catching portion for locking the optical fiber F, and the winding device 100 further includes the bobbin selection mechanism 150 for setting the bobbins B1 and B2 around which the optical fiber F is to be wound, and the cutter 160 that is a wire body cleaving mechanism for cleaving the optical fiber F locked to the bobbins B1 and B2.

The claw N may not be directly attached to the bobbins B1 and B2, and may be attached to, for example, a cover that covers a flange of a bobbin.

Accordingly, an end portion of the optical fiber F can be locked and wound around the bobbins B1 and B2 that were set by the bobbin selection mechanism 150.

A bobbin around which the optical fiber F is to be wound is set by the bobbin selection mechanism 150, so that the optical fiber F can be wound around another bobbin without reducing a wire body speed. Therefore, the optical fiber F can be continuously wound without loss.

The wire body holding mechanism 140 is at least one of a suction nozzle for suctioning the optical fiber F or a pinch roller for pinching the wire body, so that the optical fiber can be reliably held at the time of being pulled out.

A moving speed of the wire body holding mechanism 140 is slower than a wire body pulling out speed of the optical fiber F, so that the optical fiber supplied from the optical fiber base material side is not insufficient. Therefore, the optical fiber F is not strongly pulled by the wire body holding mechanism 140 during a movement of the wire body holding mechanism 140 and the optical fiber F is not broken, and the optical fiber F can be efficiently wound around the bobbins B1 and B2.

[Details of Second Embodiment of Present Disclosure]

Next, a specific structure of a wire body winding device 200 according to a second embodiment of the present disclosure will be described with reference to FIGS. 3A to 3B.

Figure 3A:
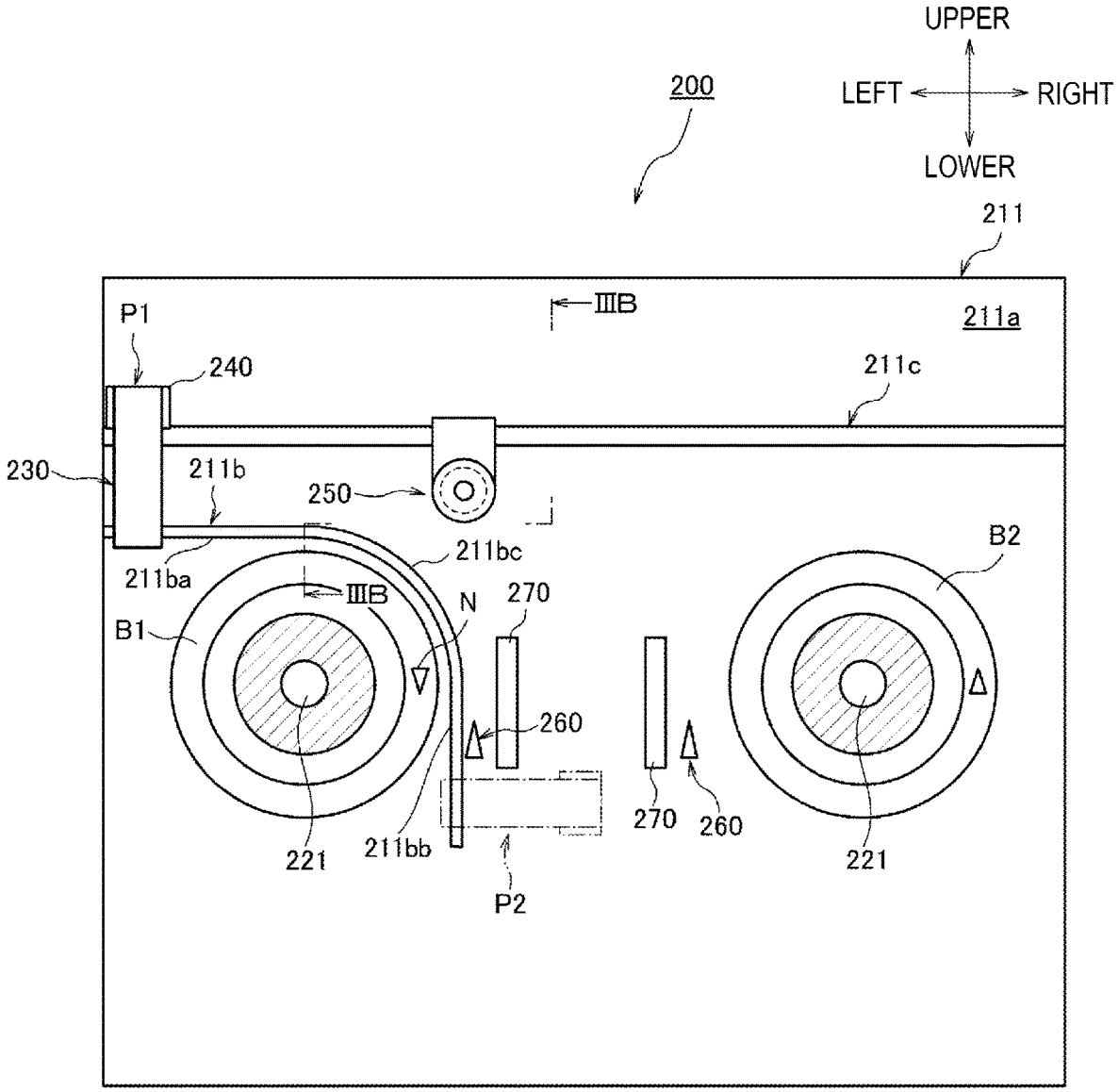
FIG. 3A is a front cross-sectional view showing a wire body winding device according to a second embodiment of the present disclosure.
Figure 3B:
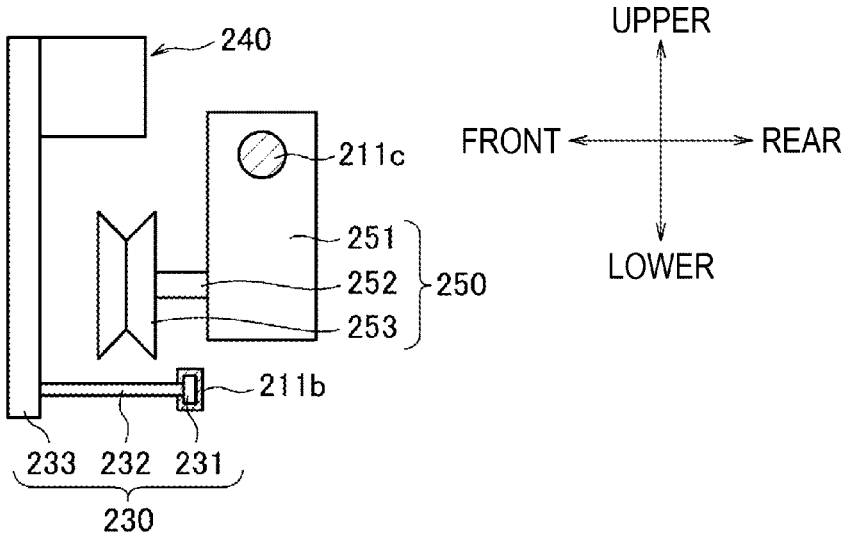
FIG. 3B is a main part cross sectional view taken along a line IIIB-IIIB in FIG. 3A.

FIG. 3A is a plan cross-sectional view showing the wire body winding device according to the second embodiment of the present disclosure. FIG. 3B is an IIIB-IIIB cross-sectional view showing main parts in FIG. 3A.

In the winding device 200 according to the second embodiment, a configuration of the first guide rail 111*b* and a structure of the wire body moving mechanism 130 in the winding device 100 according to the first embodiment are changed, and most components are the same as those in the winding device 100 according to the first embodiment. Therefore, detailed description for the same matters are omitted, and 200-series reference numbers with the same last two digits are attached.

In addition, since a wire body winding method using the winding device 200 is the same as that according to the first embodiment, description thereof will be omitted.

A first frame 211 of the winding device 200 is provided with the first guide rail 211*b* having a C-shaped cross section.

The first guide rail 211*b* is provided below a second guide rail 211*c* that extends in the left-right direction.

The first guide rail 211*b* includes a horizontal portion 211*ba* that extends in a horizontal direction, a vertical portion 211*bb* that extends in the vertical direction, and a bent portion 211*bc* that smoothly connects the horizontal portion 211*ba* and the vertical portion 211*bb*.

A wire body moving mechanism 230 in the winding device 200 includes a roller 231 that travels on the first guide rail 211*b*, an arm 232 that is coupled to the roller 231 and extends in the front-rear direction, and a holding member 233 that is coupled to a front end of the arm 232.

The holding member 233 is a member that extends in the vertical direction, a lower end side of the holding member 233 is coupled to the arm 232, and an upper end side of the holding member 233 holds a wire body holding mechanism 240.

Although embodiments of the present disclosure have been described above, the present disclosure is not limited thereto.

Components included in the embodiments described above may be combined as long as technically possible, and a combination of the components is also included in the scope of the present disclosure as long as features of the present disclosure are included.

REFERENCE SIGNS LIST

100, 200 winding device
110 frame
111, 211 first frame
111*a*, 211*a* front surface
111*b*, 211*b* first guide rail
211*ba* horizontal portion
211*bb* vertical portion
211*bc* bent portion
111*c*, 211*c* second guide frame
112 second frame
120 bobbin pivoting mechanism
120A first bobbin pivoting mechanism
120B second bobbin pivoting mechanism
121, 221 rotation shaft
121*a* pulley
121*b* kere pin
122 bearing
123 motor
124 transmission belt
125 support shaft
126 sleeve
127 bearing
130, 230 wire body moving mechanism
131 horizontal slide portion
231 roller
131*a* slide member
131*b* arm
131*c* coupling member
132 vertical slide portion
232 arm
132*a* guide shaft
132*b* guide shaft holding member
233 holding member
140, 240 wire body holding mechanism
150, 250 bobbin selection mechanism
151, 251 slider
152, 252 shaft
153, 253 guide roller
160, 260 cutter
161 arm
162 cutter blade
170, 270 wire body aligning guide
B1, B2 bobbin
H engagement hole
N claw (wire body catching portion)
P1 take-up position
P2 wire body winding position
F optical fiber (wire body)
FL pull-out portion
D dancer roller

The invention claimed is:

1. A wire body winding device that winds a wire body around a bobbin, the wire body winding device comprising:

a bobbin pivoting mechanism comprising a rotation shaft that pivotally supports and pivots the bobbin;

a wire body holding mechanism that holds the wire body by suction or by pinching; and a wire body moving mechanism configured to move the wire body holding mechanism, wherein a plurality of the bobbin pivoting mechanisms are provided, and wherein the wire body moving mechanism:

is moved in a horizontal direction, and between the plurality of the bobbin pivoting mechanisms in a vertical direction; and when the wire body is pulled out, moves the wire body holding mechanism between a take-up position where the wire body holding mechanism is capable of holding the wire body and a wire body winding position where the wire body is windable around the bobbin.

2. The wire body winding device according to claim 1, wherein each of the bobbin pivoting mechanisms includes a rotation shaft that is inserted into one end side of the bobbin to drive the bobbin, a motor that rotates the rotation shaft, and a support shaft that is inserted into the other end side of the bobbin to support the bobbin.

3. The wire body winding device according to claim 1, wherein the bobbin comprises a plurality of bobbins, the bobbin has a wire body catching portion comprising a claw that locks the wire body, the wire body winding device further comprises:

a bobbin selection mechanism comprising a slider configured to select the bobbin around which the wire body is wound; and a wire body cleaving mechanism comprising a cutter configured to cleave the wire body locked to the bobbin.

4. The wire body winding device according to claim 1, wherein the wire body holding mechanism is at least one of a suction nozzle configured to suction the wire body or a pinch roller configured to pinch the wire body.

5. The wire body winding device according to claim 1, wherein a moving speed of the wire body holding mechanism is slower than a wire body pulling out speed of the wire body.

6. A wire body winding method using a wire body winding device, the wire body winding device including a plurality of bobbin pivoting mechanisms comprising a rotation shaft that pivotally support and pivot a bobbin around which a wire body is to be wound, a wire body holding mechanism that holds the wire body by suction or by pinching, a wire body moving mechanism configured to move the wire body holding mechanism, a bobbin selection mechanism comprising a slider configured to select the bobbin around which the wire body is to be wound, and a wire body cleaving mechanism comprising a cutter configured to cleave the wire body, the wire body winding method comprising:

holding the wire body by the wire body holding mechanism when the wire body is pulled out;

moving the wire body holding mechanism in a horizontal direction, and between the plurality of the bobbin pivoting mechanisms in a vertical direction, to a wire body winding position where the wire body is windable around the bobbin after the holding;

selecting the bobbin around which the wire body is to be wound by the bobbin selection mechanism after the moving;

locking the wire body by a wire body catching portion comprising a claw after the setting; and cleaving the wire body locked to the bobbin by the wire body cleaving mechanism after the locking.

* * * * *